US007267156B2

(12) United States Patent
Byeon

(10) Patent No.: US 7,267,156 B2
(45) Date of Patent: Sep. 11, 2007

(54) BLINDS FOR ADJUSTING ILLUMINATION

(76) Inventor: Tae Woong Byeon, 219-14 Deokpung-dong, Hanam-si, Gyeonggi-do (KR) 465-010

( * ) Notice: Subject to any disclaimer, the term of this patent is extended or adjusted under 35 U.S.C. 154(b) by 278 days.

(21) Appl. No.: 11/049,172

(22) Filed: Feb. 2, 2005

(65) Prior Publication Data

US 2005/0178509 A1 Aug. 18, 2005

(30) Foreign Application Priority Data

Feb. 12, 2004 (KR) ..... 20-2004-0003559 U
Jul. 14, 2004 (KR) ..... 20-2004-0020094 U

(51) Int. Cl.
*E06B 9/08* (2006.01)

(52) U.S. Cl. ..... 160/121.1; 160/323.1

(58) Field of Classification Search ..... 160/120, 160/121.1, 85, 86, 321, 326, 323.1, 324, 160/325, 274
See application file for complete search history.

(56) References Cited

U.S. PATENT DOCUMENTS 2,280,358 A * 4/1942 Tietig ..... 160/120
3,854,517 A * 12/1974 Nakamura ..... 160/323.1
5,566,736 A * 10/1996 Crider et al. ..... 160/121.1
6,189,592 B1 * 2/2001 Domel ..... 160/85
6,540,004 B2 * 4/2003 Wu ..... 160/321
6,666,251 B2 * 12/2003 Ikle ..... 160/120
6,935,401 B2 * 8/2005 Fraczek et al. ..... 160/321

* cited by examiner

*Primary Examiner*—David M. Purol
*Assistant Examiner*—Candace L. Bradford
(74) *Attorney, Agent, or Firm*—Madson & Austin

(57) ABSTRACT

The present invention relates to a blind of a roll type comprising a blind sheet having alternate transparent and opaque parts and partly overlapped by folding, to easily and efficiently adjust room illumination. The blind comprises a upper-end support bar; a pair of brackets provided at both ends of the upper-end support bar, standing opposite to each other; a winding rod of which both ends are rotatably fitted into the respective brackets; an adjusting cord provided between one bracket and the winding rod to rotate the winding rod through a sprocket member; a blind sheet comprising alternate transparent and opaque parts and folded to have one end secured to the winding rod and the other end secured to the upper-end support bar; and a weight body provided at a lower end of the blind sheet to stretch the blind sheet tight.

7 Claims, 7 Drawing Sheets

BLINDS FOR ADJUSTING ILLUMINATION

FIELD OF THE INVENTION

The present invention relates to blinds for adjusting illumination, and more particularly to blinds of a roll type comprising a blind sheet having alternate transparent and opaque parts and partly overlapped by folding, by which room illumination can be easily and efficiently adjusted.

BACKGROUND OF THE INVENTION

In general, shielding members such as curtains or blinds are used to hinder vision or shut out light through windows.

In order to adjust the room illumination by using such conventional shielding members, they had to be moved to the right/left or upper/lower direction, in which case the interior of a room could be seen from the outside and it could be an invasion of privacy or a public nuisance.

Thus, a new type of blind has recently been developed, wherein the blind comprises a blind sheet having alternate transparent and opaque parts and overlapped by folding, so that the room illumination can be adjusted without moving the blind to the right or left or to the upper or lower direction and without exposing the interior of the room to the outside.

FIG. 1 is a disassembled perspective view of such a conventional blind having an overlapping blind sheet, and FIG. 2 is a side view of a part of the blind wherein a clutch spring is provided in a bracket of the blind. FIG. 3 is a side view showing operating states of the conventional blind. Such conventional blind has been disclosed in Japanese Patent Laid-open Publication No. 1995-189,573.

A blind sheet (14) is folded to have a front blind sheet (14*a*) and a rear blind sheet (14*b*), with their upper end being wound or unwound together around a winding rod (12). The lower end of the blind sheet (14) is looped centering around a weight bar (16).

As shown in FIG. 3, the blind sheet (14) has alternate transparent and opaque parts (13 and 15) with a predetermined width.

The transparent parts (13) are formed by sparsely weaving the blind sheet (14), so that the air and light can penetrate into the room through it.

A clutch axis (18) is integrally formed with the winding rod (12) for rotation at the right end of the winding rod (12). The clutch axis (18) has a rectangular bore (20) in the center thereof, along its axial direction.

Further, a fluctuating rod (22) is provided between the front blind sheet (14*a*) and the rear blind sheet (14*b*) at a predetermined distance from the winding rod (12).

Both ends of the fluctuating rod (22) are respectively fitted to openings, which are respectively formed at ends of fluctuating members (23 and 24). At the other ends of the fluctuating members (23 and 24), openings (25 and 26) are provided to respectively fit to an end (12*a*) of the winding rod (12) and the clutch axis (18).

A protrusion (28) is formed below the opening (26) of the fluctuating member (24).

Also, a clutch spring (30) is provided adjacent to the fluctuating member (24) to be fitted to the periphery of the clutch axis (18).

The clutch spring (30) has both ends (30*a* and 30*b*) curved to the outside of the periphery of the clutch axis (18) so that the protrusion (28) formed below the opening (26) of the fluctuating member (24) can be positioned between the curved ends (30*a* and 30*b*).

When the blind sheet (14) is deployed to its farthest end, the clutch spring (30) is coupled to the clutch axis (18) to rotate integrally with the clutch axis (18). However, when a diameter of the clutch spring (30) increases by the movement of the fluctuating member (24) as described below, clutching of the clutch axis (18) is released, and then only the clutch axis (18) rotates.

Brackets (32 and 34) are provided beside the fluctuating members (23 and 24) at the ends of the winding rod (12*a*) and the clutch axis (18) to rotatably support the winding rod (12) and the clutch axis (18).

As shown in FIG. 1, a left bracket (32) has a receiving opening (33) into which the end of the winding rod (12*a*) passing through the opening (25) of the fluctuating member (23) is fitted. Also, a right bracket (34) has a receiving opening (36) into which the clutch spring (30) is fitted and also has a truncated part (38) in a lower part of the receiving opening (36).

The curved ends (30*a* and 30*b*) of the clutch spring (30) are located in the truncated part (38) and they move within the truncated part (38).

If one curved end (30*a*) of the clutch spring (30) is in contact with one end (38*a*) of the truncated part (38), the protrusion (28) of the fluctuating member (24) is vertically positioned, and if the fluctuating member (24) and the protrusion (28) are rotated to a predetermined angle, the other curved end (30*b*) of the clutch spring (30) comes into contact with the other end (38*b*) of the truncated part (38).

The clutch spring (30) is fitted to the clutch axis (18), which is therefore rotatably supported by the bracket (34).

Adjacent to the bracket (34), an operating gear (40) is provided, which has a rectangular bore (42) in the center thereof and is surrounded by using cord (44) along its periphery.

Into the rectangular bore (42) of the operating gear (40) and into the rectangular bore (20) of the clutch axis (18), a square bar (46) is inserted to integrally rotate the operating gear (40) and the clutch axis (18).

Accordingly, in order to lower the blind sheet (14), a string (44*a*) of the adjusting cord (44) is pulled down, so that the operating gear (40) rotates clockwise in FIG. 1.

Then, the clutch axis (18) and the winding rod (12) are rotated together with the operating gear (40) by the square bar (46), and the clutch spring (30) is also rotated clockwise in the receiving opening (36).

This rotation of the clutch spring (30) detaches the curved end (30*a*) of the clutch spring (30) from the end (38*a*) of the truncated part (38), and the rotation stops when the other curved end (30*b*) of the clutch spring (30) comes into contact with the other end (38*b*) of the truncated part (38).

During this rotation, the protrusion (28) is moved from the position A to the position B in FIG. 2 and the fluctuating rod (22) moves clockwise to the position B as shown in one-dot chain lines in FIG. 3.

Then, if the string (44*a*) of the adjusting cord (44) is further pulled down, the winding rod (12) will rotate further and the curved end (30*b*) of the clutch spring (30) will be pressed by the other end (38*b*) of the truncated part (38). As a result, the clutch spring (30) will become loose and be released from the clutch axis (18), so that only the winding rod (12) will keep rotating.

Accordingly, the blind sheet (14) can be pulled down to a desired position.

Then, if the blind sheet (14) is to be stopped, pulling down the adjusting cord (44) should be stopped, which will stop the rotation of the operating gear (40).

Accordingly, the winding rod (12) stops rotating and the blind sheet (14) is not pulled down any more.

When the operating gear (40) stops rotating, the clockwise rotational force from the clutch spring (30) does not act on the fluctuating member (24), but the downward force by the weight bar (16) acts on the fluctuating member (24), so that the fluctuating member (24) tends to rotate counterclockwise in FIG. 2.

Thus, the protrusion (28) of the fluctuating member (24) presses the curved end (30*a*) of the clutch spring (30) counterclockwise, and the clutch spring (30) is fastened to fit to the clutch axis (18). Therefore, the rotation of the fluctuating member (24) is restrained and the fluctuating rod (22) maintains the position B in FIG. 3.

When the fluctuating rod (22) is in the position B as in FIG. 3, the opaque parts (15) of the front blind sheet (14*a*) are overlapped with the transparent parts (13) of the rear blind sheet (14*b*) and the blind sheet (14) becomes entirely opaque, so that lighting and ventilation through the blind (10) cannot be done.

On the contrary, in order to light and ventilate through the blind (10), it is necessary to pull down the other string (44*b*) of the adjusting cord (44) to rotate the operating gear (40) counterclockwise.

Then, the clutch axis (18) and the winding rod (12) are rotated together with the operating gear (40) by the square bar (46) and the clutch spring (30) also rotates counterclockwise in the receiving opening (36).

If the clutch spring (30) rotates counterclockwise, the other curved end (30*b*) of the clutch spring (30) is detached from the other end (38*b*) of the truncated part (38), and the rotation continues until the curved end (30*a*) of the clutch spring (30) comes into contact with the end (38*a*) of the truncated part (38).

During this rotation, the protrusion (28) is moved from the position B to the position A and the fluctuating rod (22) moves counterclockwise to the position A as in FIG. 3.

Therefore, by overlapping the transparent parts (13) or the opaque parts (15) of the front blind sheet (14*a*) with those of the rear blind sheet (14*b*) by the rotation of the fluctuating member (24), the blind sheet (14) can adjust lighting and ventilation.

However, the conventional blind (10) as described above had the following disadvantages.

Firstly, since the conventional blind necessitated a pair of fluctuating members (24), the fluctuating rod (22) and the clutch spring (30) to align the transparent parts (13) or the opaque parts (15) of the front and rear blind sheets or to alternate them, it was not economical in terms of manufacturing costs and the productivity.

Secondly, even if the blind sheet (14) were to be unwound by pulling down the adjusting cord (44), it happened occasionally that the front blind sheet (14*a*) was suspended or held on the winding rod (12) and the blind sheet (14) could not be unwound smoothly.

Thirdly, since the front blind sheet (14*a*) was kept slant by the fluctuating rod (22), while the rear blind sheet (14*b*) was kept vertically, it was difficult to adjust the transparent and opaque parts to be exactly overlapped.

That is, since the front blind sheet (14*a*) was positioned distant from the rear blind sheet (14*b*), it was not easy to adjust illumination appropriately.

Finally, since the front blind sheet (14*a*) was to be positioned away from the rear blind sheet (14*b*) by the fluctuation of the fluctuating rod (22), a lot of space around windows was required for installation of the conventional blind.

SUMMARY OF THE INVENTION

Accordingly, the object of the present invention is to solve the above disadvantages of conventional blinds by providing a roll-type blind comprising a front blind sheet and a rear blind sheet which are suspended vertically together around a winding rod and rapidly adjustable by aligning or misaligning transparent and opaque parts of the blind sheets, so that the room illumination can be effectively and rapidly adjusted.

Another object of the present invention is to provide a roll-type blind, in which only one end of the roll-type blind is wound or unwound on a winding rod, with the other end fixed on a support bar, and thus overlapping of the transparent parts with opaque parts of the blind sheet can be easily adjustable with high reliability.

A further object of the present invention is to provide a non-fluctuating blind which moves up and down with stability.

In order to achieve the above objects, a blind for adjusting illumination according to the present invention comprises a upper-end support bar; a pair of brackets provided at both ends of the upper-end support bar, standing opposite to each other; a winding rod of which both ends are rotatably fitted into the respective brackets; an adjusting cord provided between one bracket and the winding rod to rotate the winding rod through a sprocket member; a blind sheet comprising alternate transparent and opaque parts and folded to have one end secured to the winding rod and the other end secured to the upper-end support bar; and a weight body provided at a lower end of the blind sheet to stretch the blind sheet tight.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention, wherein.

DETAILED DESCRIPTION OF THE PREFERRED EMBODIMENTS

Figure 1:
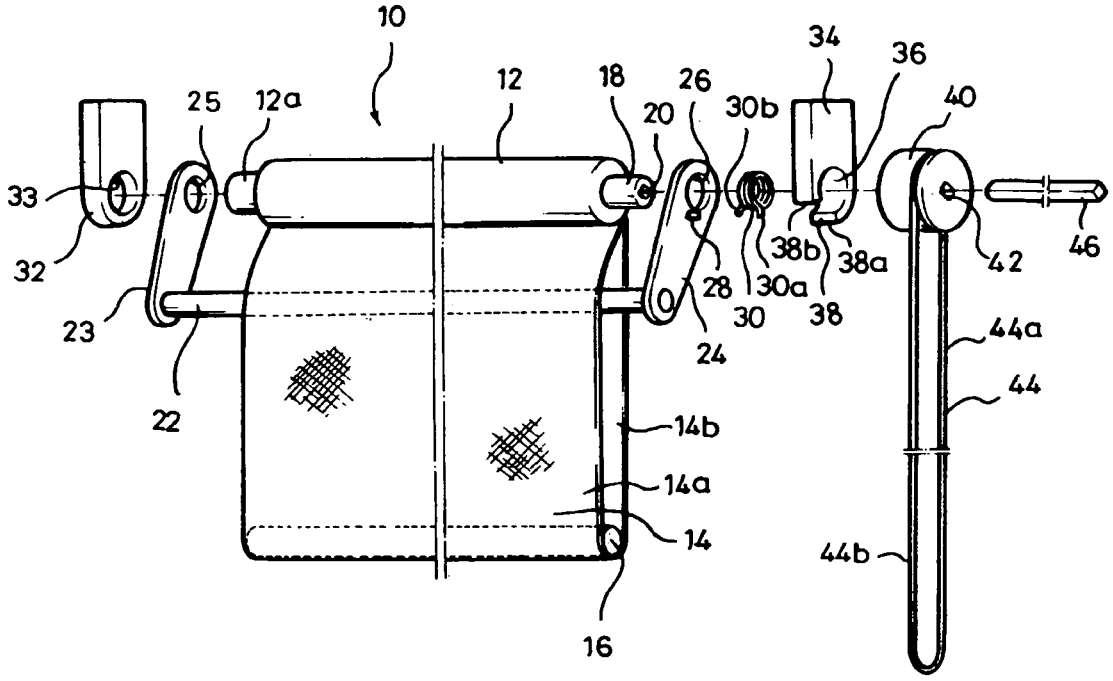
FIG. 1 PRIOR ART
FIG. 1 is a disassembled perspective view of a conventional blind.
Figure 2:
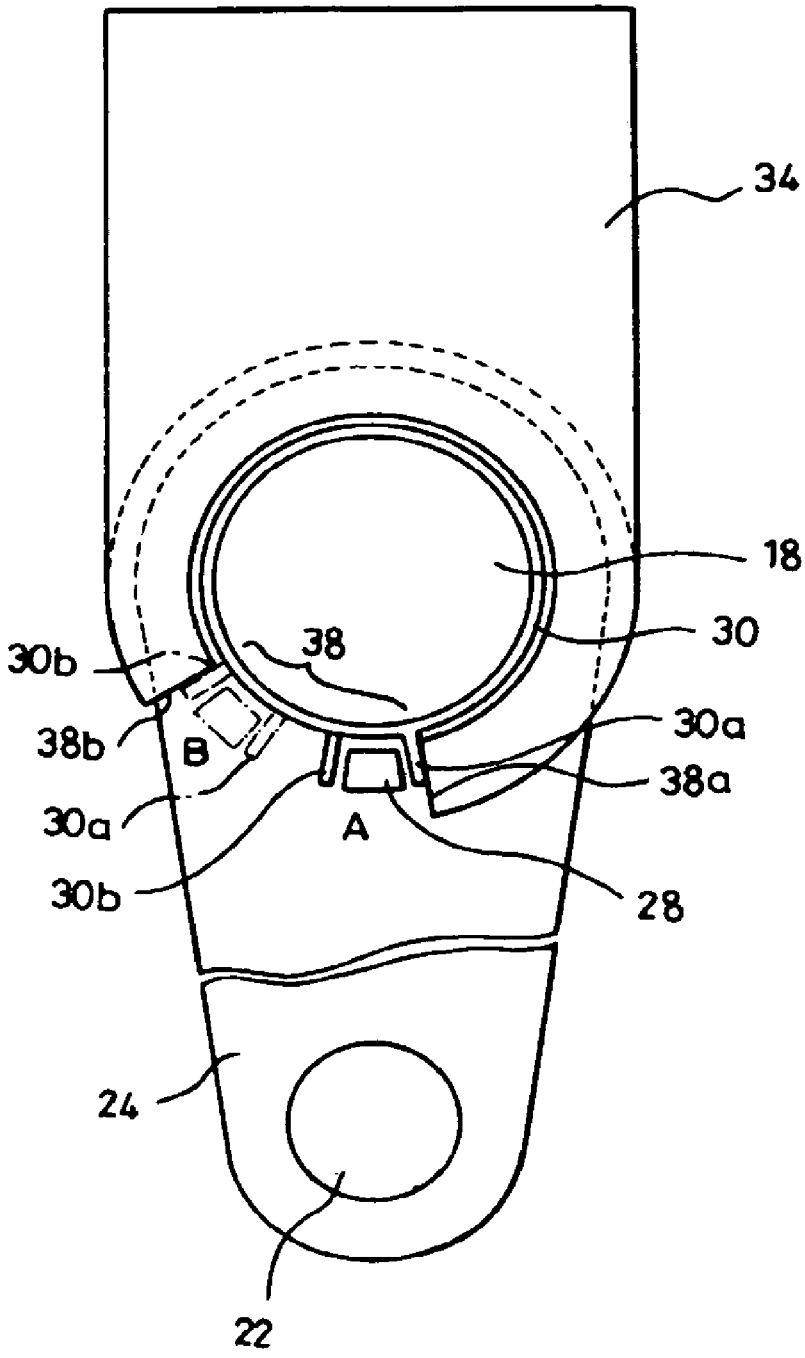
FIG. 2 PRIOR ART
FIG. 2 is a side view showing a part of the conventional blind of FIG. 1, wherein a clutch spring is installed in a bracket.
Figure 3:
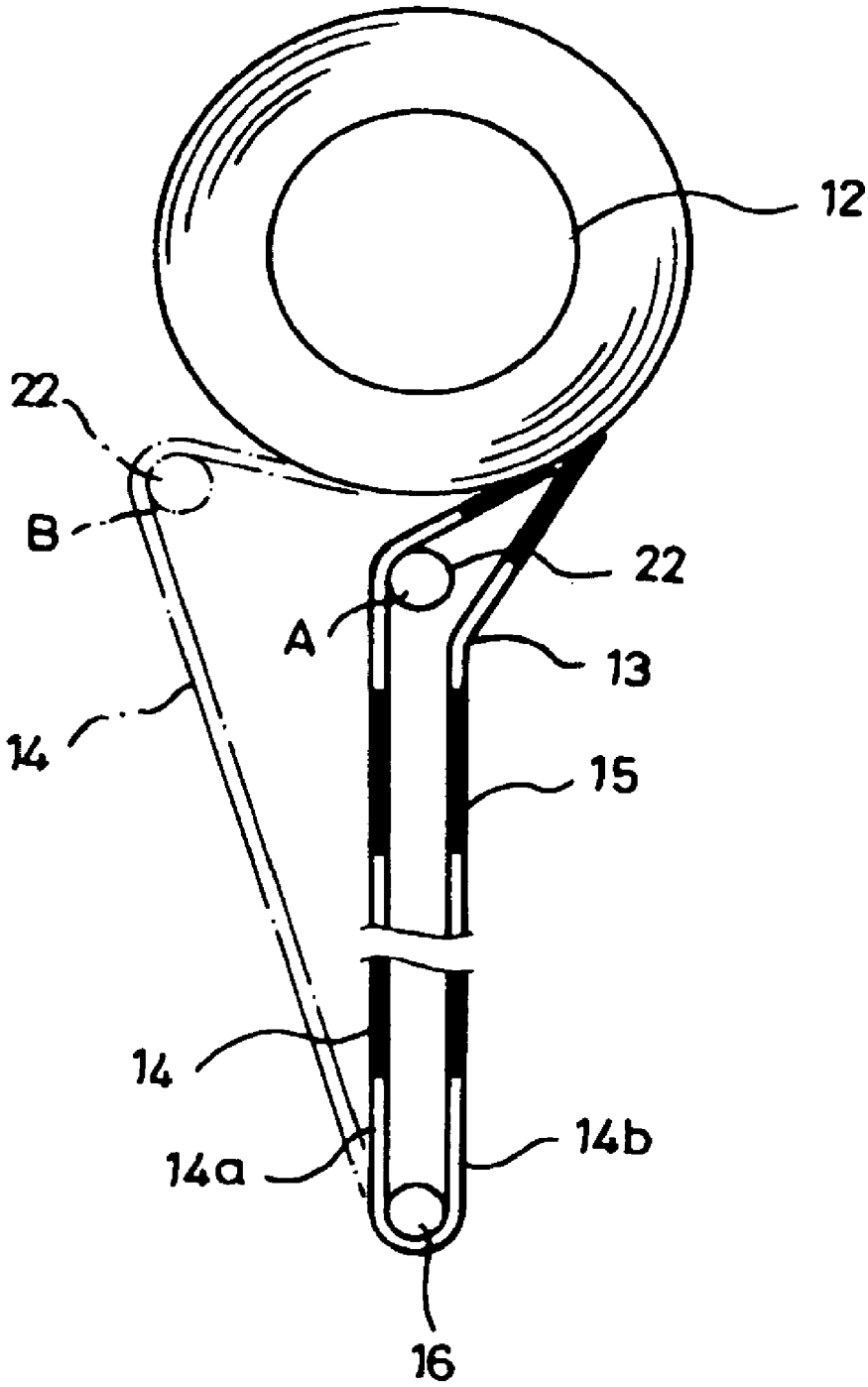
FIG. 3 PRIOR ART
FIG. 3 is a side view showing operating states of the conventional blind of FIG. 1.
Figure 4:
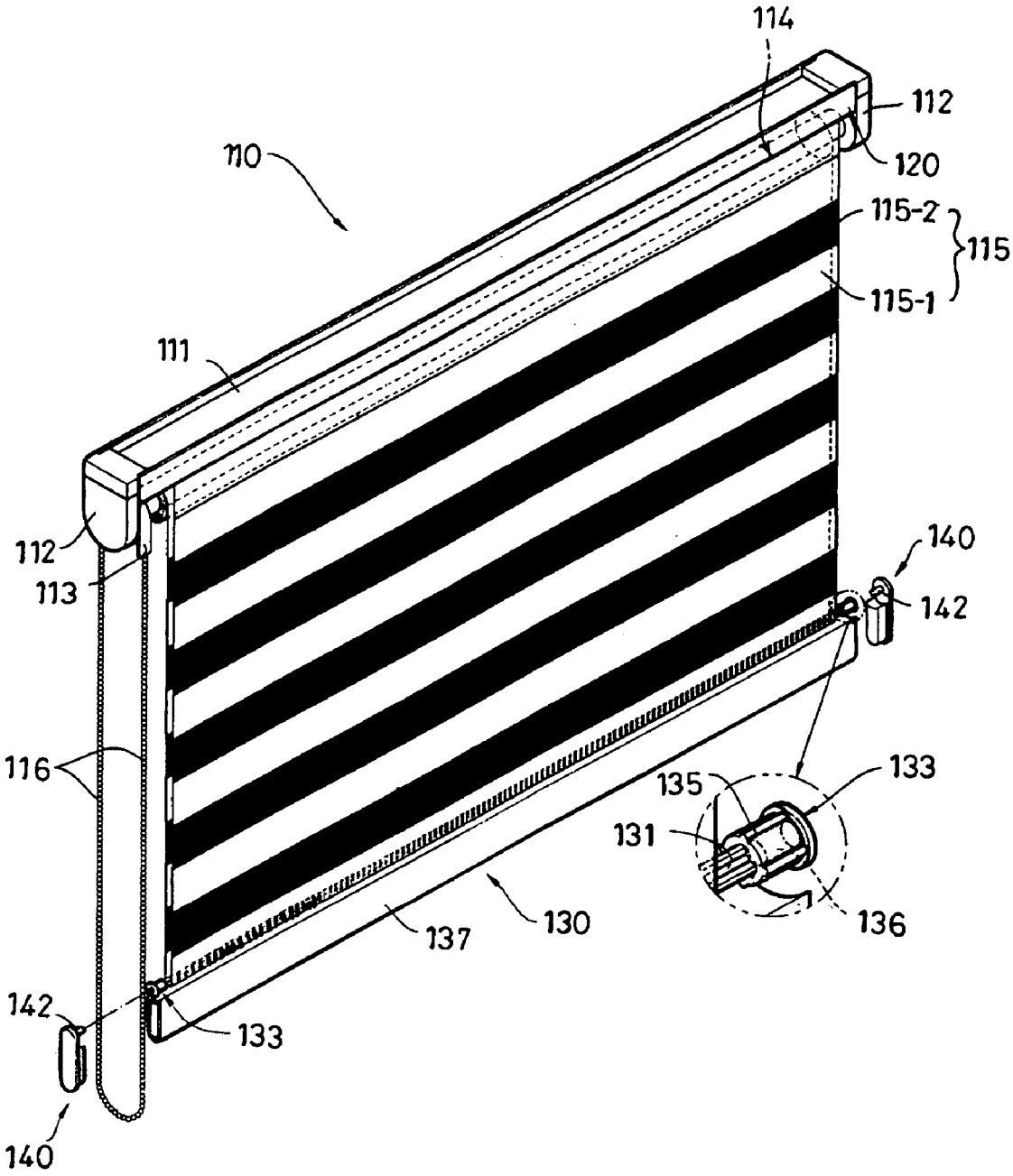
FIG. 4 is a perspective view of a blind according to the present invention partly disassembled.
Figure 5:
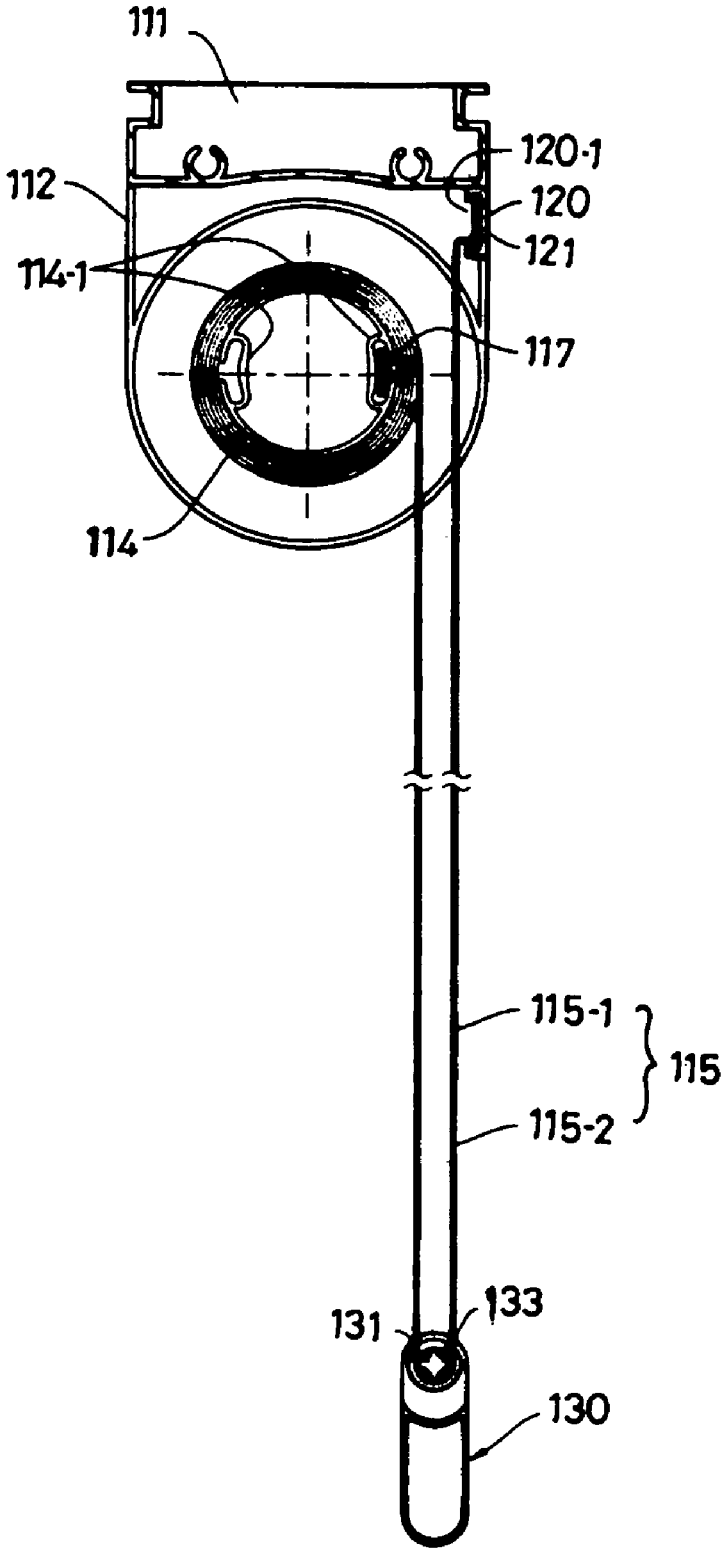
FIG. 5 is a longitudinal sectional view of the blind of FIG. 4.

Reference will now be made in detail to preferred embodiments of the present invention in conjunction with the accompanying drawings.

Referring to FIGS. 4 to 8, a blind (110) for adjusting illumination according to the present invention comprises a upper-end support bar (111); a pair of brackets (112) provided at both ends of the upper-end support bar (111), standing opposite to each other; a winding rod (114) of which both ends are rotatably fitted into the respective brackets (112); an adjusting cord (116) provided between one bracket (112) and the winding rod (114) to rotate the winding rod (114) through a sprocket member (113); a blind sheet (115) comprising alternate transparent and opaque parts (115-1 and 115-2) and folded to have one end secured to the winding rod (114) and the other end secured to the upper-end support bar (111); and a weight body (130) provided at a lower end of the blind sheet (115) to stretch the blind sheet (115) tight.

In providing the winding rod (114) between the brackets (112), the left end of the winding rod (114) is fitted into the bracket (112) through the sprocket member (113) operated by the adjusting cord (116).

The upper-end support bar (111) has an extended tongue (120) integrally formed therewith at a lower end for attaching one end of the blind sheet (115) thereto. The other end of the blind sheet (115) is attached to the winding rod (114).

In the process of attaching the blind sheet (115) to the extended tongue (120) and the winding rod (114), fixing members such as screws, bands and the like may be used. However, it would be more preferable to mount the blind sheet (115) without using such fixing members.

For this purpose, according to an embodiment of the present invention, the winding rod (114) may include more than one seating part (114-1) and the blind sheet (115) may include a fixing piece (117) at one end thereof, so that the fixing piece (117) can be fitted into the seating part (114-1).

Further, the extended tongue (120) may have a seating groove (120-1) and the blind sheet (115) may have another fixing piece (121) at the other end thereof, so that the fixing piece (121) can be fitted into the seating groove (120-1).

Accordingly, the blind sheet (115) can be installed on the extended tongue (120) and the winding rod (114) without additional fixing members.

The extended tongue (120) may be formed separately from the upper-end support bar (111), but it would be more preferable to integrally form the extended tongue (120) with the upper-end support bar (111) in consideration of manufacturing costs and productivity.

The blind sheet (115) stretches tight by the weight body (130) provided at the folded lower end of the blind sheet (115).

Figure 6:
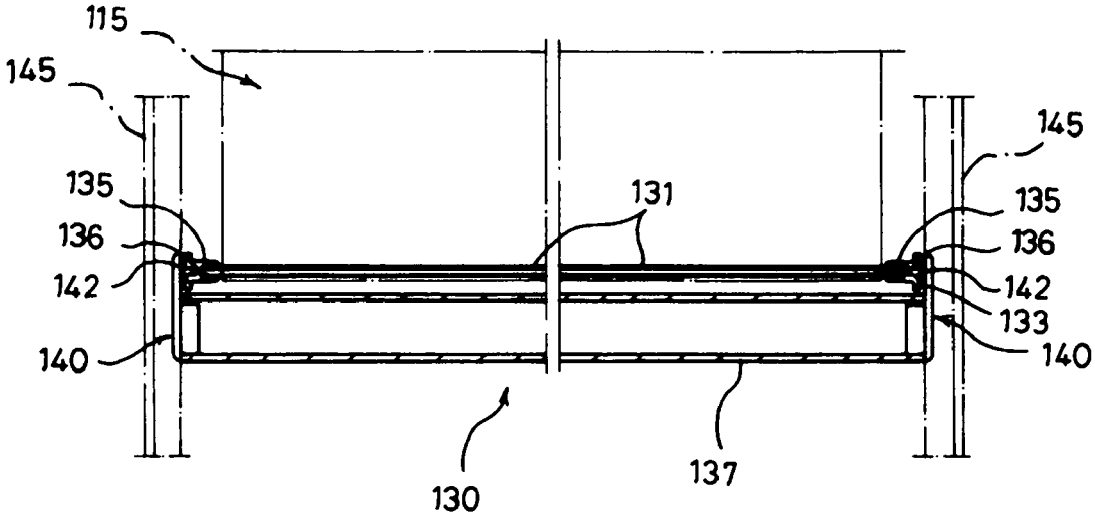
FIG. 6 is a sectional view showing an embodiment of a weight body of the blind according to the present invention.

FIG. 6 is a sectional view showing one embodiment of the weight body (130), wherein the weight body (130) comprises a rod (131) provided in a loop at the lower end of the blind sheet (115); a weight bar (137) provided below the blind sheet (115) to stretch the blind sheet (115) tight by its weight; and fixing caps (140) provided on both ends of the rod (131) and the weight bar (137) to connect them.

It is preferable that a pair of rotational caps (133) are provided at both ends of the rod (131) to be connected to the fixing caps (140), so that the rod (131) can rotate smoothly in the loop of the blind sheet (115) when the blind sheet (115) moves up and down.

In an embodiment of the present invention, each of the rotational caps (133) may include an axial bore (136) at one end to be connected to an axial protrusion (142) formed on an internal surface of the fixing cap (140) and may also include a fixing groove (135) at the other end to receive the end of the rod (131) therein. Accordingly, the rotational caps (133) can rotate centering around the axial protrusions (142) and can rotate the rod (131) smoothly in the fixing caps (140).

Figure 7:
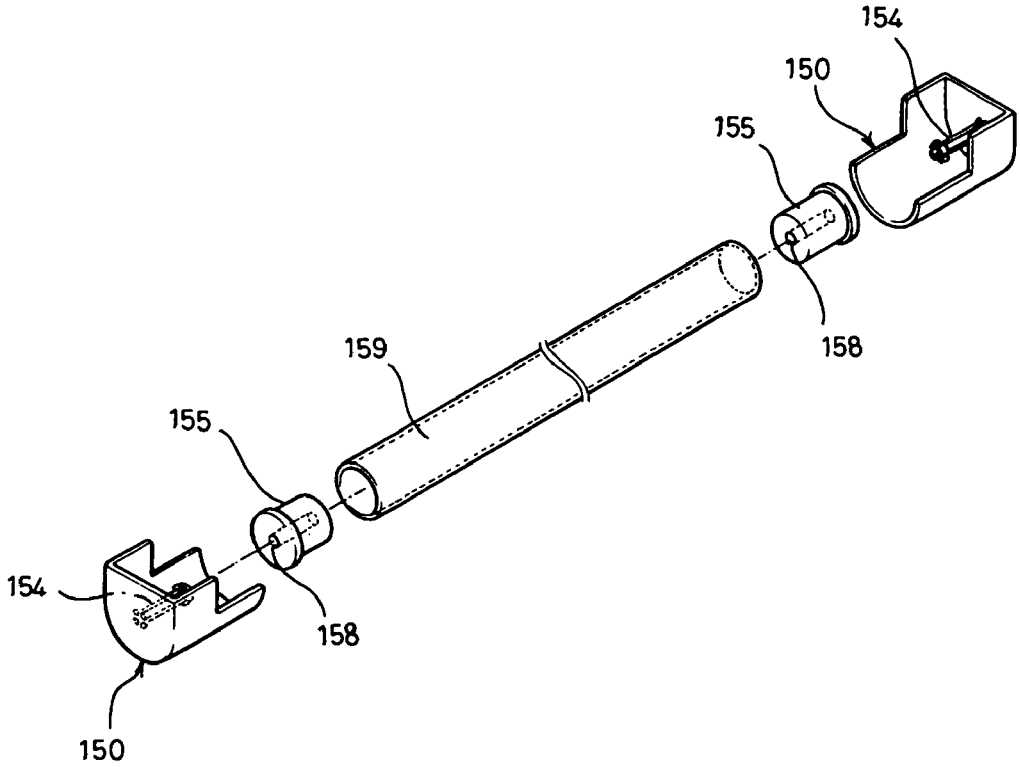
FIG. 7 is a disassembled perspective view showing another embodiment of the weight body of the blind according to the present invention.
Figure 8:
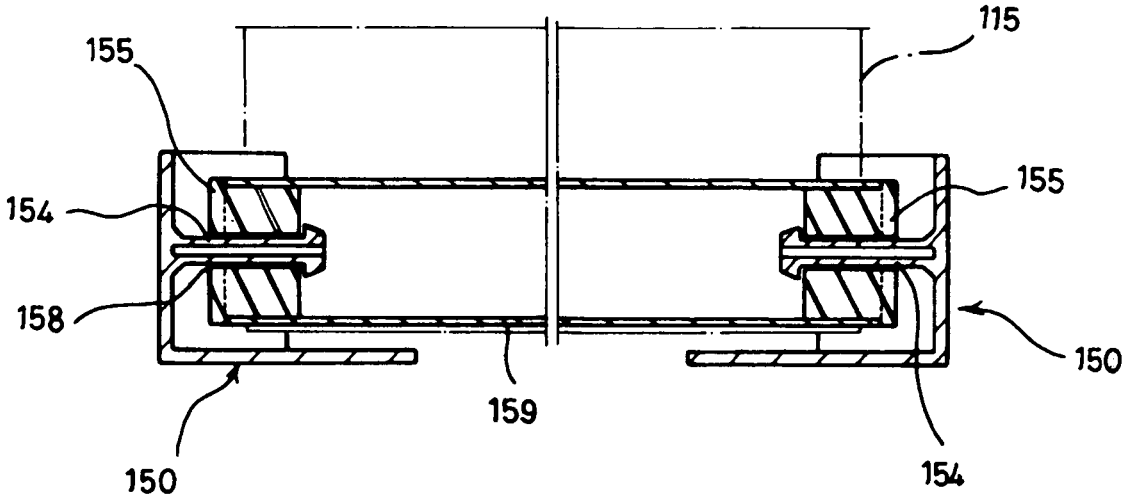
FIG. 8 is a sectional view of the weight body of FIG. 7 in an assembled state.

FIG. 7 shows another embodiment of the weight body (130) in a disassembled state and FIG. 8 is a sectional view of the weight body (130) of FIG. 7 in an assembled state, wherein the weight body (130) comprises a weight bar (159) having a hollow center to be provided in the loop at the lower end of the blind sheet (115); rotational caps (155) provided at both ends of the weight bar (159) to cover the ends of the weight bar (159), each of which having an axial bore (158) in the center thereof; a pair of fixing caps (150) having respective axial protrusions (154) to be connected to the axial bores (158) of the rotational caps (155), thus closing both ends of the weight bar (159) and allowing the rotational caps (155) to rotate smoothly therein.

Meanwhile, when the window is high, the blind sheet (115) may pitch and roll in winding or unwinding it on the winding rod (114). Thus, means to prevent noise and damage on windows or walls due to the fluctuation of the blind sheet (115) may be further provided.

Referring to FIG. 6, according to a further embodiment of the present invention, vertical guide rails (145) may be provided at both ends of the blind sheet (115) so that the fixing caps (140 or 150) can be respectively fitted to the vertical guide rails (145). The vertical guide rails (145) may be formed in the shape of substantially "⊏".

The blind according to the present invention as constructed above will operate and function as mentioned hereinafter.

If the adjusting cord (116) at one end of the upper-end support bar (111) is pulled down counterclockwise, the winding rod (114) will rotate counterclockwise.

If the winding rod (114) rotates, the front blind sheet (115) having one end fixed on the seating part (114-1) is wound on the winding rod (114), so that the blind sheet (115) rises up gradually.

When the front blind sheet (115) winds up along the winding rod (114), the rod (131) of the weight body (130) in the loop of the blind sheet (115) freely rotates, keeping the blind sheet (115) stretched tight. Therefore, the blind sheet (115) can be easily wound on the winding rod (114).

If the vertical guide rails (145) are provided on both sides of the blind sheet (115), the fixing caps (140 or 150) move along grooves formed in the vertical guide rails (145) with stability, so that the blind sheet (115) and the weight body (130) can ascend vertically without fluctuation.

On the contrary, if the adjusting cord (116) is pulled down clockwise, the winding rod (114) rotates clockwise and the blind sheet (115), which has been wound on the winding rod (114), becomes deployed gradually and hangs down.

When the blind sheet (115) is deployed, the rod (131) of the weight body (130) in the loop at the lower end of the blind sheet (115) rotates counterclockwise, so that the blind sheet (115) can be stretched tight.

Also, when the blind sheet (115) is deployed, since the fixing caps (140 and 150) move along the grooves formed in the vertical guide rails (145), the blind sheet (115) and the weight body (130) can descend vertically with stability without fluctuation.

As described above, by adjusting freely the blind sheet (115) to be wound or unwound on the winding rod (114), regardless of the position of the blind sheet (115), the transparent parts (115-1) and the opaque parts (115-2) of the blind sheet (115) can be overlapped or misaligned freely, and accordingly the room illumination can be rapidly and effectively adjusted.

That is, by pulling down the adjusting cord (116) clockwise or counterclockwise, one end of the blind sheet (115), which has been fixed on the winding rod (114), becomes wound or unwound, while the other end of the blind sheet (115), which has been fixed on the seating groove (120-1) of the extended tongue (120), is kept fixed, so that the degree of overlapping the transparent parts (115-1) and the opaque parts (115-2) can be freely adjusted.

When the blind sheet (115) is drawn up or pulled down by the movement of the adjusting cord (116), since the weight body (130) is provided in the loop at the lower end of the blind sheet (115), the rod (131) and the rotational caps (133) are rotated clockwise or counterclockwise.

Further, since the rod (131) is pulled downward by the weight bar (137) below the blind sheet (115), the blind sheet (115) can be stretched tight all the time.

Likewise, referring to FIGS. 7 and 8, as the blind sheet (115) is drawn up or pulled down by the adjusting cord (116), the weight bar (159) in the loop at the lower end of the blind sheet (115) rotates clockwise or counterclockwise together with the rotational caps (155), so that the blind sheet (115) hangs down by its weight and can be kept tight all the time.

As described above, according to the present invention, the following advantages are obtained.

Firstly, since the roll-type blind according to the present invention comprises the front blind sheet and the rear blind sheet, which are suspended vertically together around the winding rod and rapidly adjustable by aligning or misaligning transparent and opaque parts of the blind sheets, the room illumination can be effectively and rapidly adjusted.

Further, according to the present invention, since only one end of the roll-type blind is wound or unwound on the winding rod, with the other end fixed on the support bar, overlapping of the transparent parts with opaque parts of the blind sheet can be easily adjustable with high reliability.

Further, according to the present invention, the roll-type blind is not fluctuating and moves up and down with stability.

Furthermore, according to the present invention, since the front blind sheet of the blind is not kept slant as in the conventional blind, but is vertically kept without fluctuation, a lot of space around windows is not required for the installation of the blind.

Finally, due to the vertical guide rails provided on both sides of the blind sheet, noise and damage on windows or walls, which occurred by the collision of the blind sheet with the windows or walls or its fluctuation, can be prevented.

It will be apparent to those skilled in the art that various modifications and variations can be made to the present invention without departing from the spirit and scope of the invention. The present invention covers the modifications and variations thereof provided they come within the scope of the appended claims and their equivalents.

What is claimed is:

1. A blind for adjusting illumination comprising:

an upper-end support bar;

a pair of brackets provided at both ends of the upper-end support bar, standing opposite to each other;

a winding rod of which both ends are rotatably fitted into the respective brackets;

an adjusting cord provided between one bracket and the winding rod to rotate the winding rod through a sprocket member;

a blind sheet comprising alternate transparent and opaque parts and folded to have one end secured to the winding rod and the other end secured to the upper-end support bar;

a weight body provided at a lower end of the blind sheet to stretch the blind sheet tight;

wherein the winding rod includes more than one seating part and the blind sheet includes a fixing piece at one end thereof, so that the fixing piece can be fitted into the seating part, wherein the upper-end support bar has an extended tongue formed at its lower end for fixing one end of the blind sheet thereon;

wherein the extended tongue has a seating groove and the blind sheet has a further fixing piece at the other end thereof, so that the fixing piece can be fitted into the seating groove; and wherein the weight body further comprises:

a rod provided in a loop at a lower end of the blind sheet;

a weight bar provided below the blind sheet; and fixing caps provided on both ends of the rod and the weight bar to connect them each other.

2. The blind as claimed in claim 1, wherein a pair of rotational caps are provided at both ends of the rod to be connected to the fixing caps, and each of the rotational caps includes an axial bore at one end to be connected to an axial protrusion formed on an internal surface of each of the fixing caps and also includes a fixing groove at the other end to receive an end of the rod therein.

3. The blind as claimed in claim 1, wherein the weight body comprises a weight bar having a hollow center to be provided in the loop at the lower end of the blind sheet; rotational caps provided at both ends of the weight bar to cover the ends of the weight bar, each of which having an axial bore in the center thereof; a pair of fixing caps having respective axial protrusions to be connected to the axial bores of the rotational caps, thus closing both ends of the weight bar and allowing the rotational caps to rotate smoothly therein.

4. The blind as claimed in claim 1, wherein vertical guide rails facing each other are provided at both ends of the blind sheet so that the fixing caps can be respectively fitted to the vertical guide rails.

5. The blind as claimed in claim 4, wherein the cross section of the vertical guide rails is formed in the shape of "⊏".

6. The blind as claimed in claim 3, wherein vertical guide rails facing each other are provided at both ends of the blind sheet so that the fixing caps can be respectively fitted to the vertical guide rails.

7. The blind as claimed in claim 6, wherein the cross section of the vertical guide rails is formed in the shape of "⊏".

* * * * *